US006743152B2

(12) United States Patent
Weiss

(10) Patent No.: US 6,743,152 B2
(45) Date of Patent: Jun. 1, 2004

(54) ADJUSTABLE BALLET BAR EXERCISE DEVICE

(75) Inventor: Roger Weiss, Foxboro, MA (US)

(73) Assignee: Fluidity Enterprises, Inc., New York, NY (US)

( * ) Notice: Subject to any disclaimer, the term of this patent is extended or adjusted under 35 U.S.C. 154(b) by 0 days.

(21) Appl. No.: 09/955,354

(22) Filed: Sep. 17, 2001

(65) Prior Publication Data

US 2002/0035016 A1 Mar. 21, 2002

Related U.S. Application Data

(60) Provisional application No. 60/233,507, filed on Sep. 19, 2000.

(51) Int. Cl.[7] ..... A63B 1/00; A63B 4/00

(52) U.S. Cl. ..... 482/38; 482/34

(58) Field of Search ..... 482/34, 38–42, 482/134, 142; 108/50.02, 155

(56) References Cited

U.S. PATENT DOCUMENTS

| | | | | | |
|---|---|---|---|---|---|
| 860,517 | A | * | 7/1907 | Berglund | 482/41 |
| 4,111,414 | A | * | 9/1978 | Roberts | 482/39 |
| 4,126,307 | A | * | 11/1978 | Stevenson | 482/39 |
| 4,696,470 | A | * | 9/1987 | Fenner | 482/142 |
| 4,815,732 | A | * | 3/1989 | Mahvi | 482/142 |
| 5,662,556 | A | * | 9/1997 | Gangloff | 482/38 |
| 6,336,414 | B1 | * | 1/2002 | Stewart et al. | 108/50.02 |
| 6,415,723 | B1 | * | 7/2002 | Kopish et al. | 108/50.02 |

* cited by examiner

*Primary Examiner*—Nicholas D. Lucchesi
*Assistant Examiner*—Fenn Mathew
(74) *Attorney, Agent, or Firm*—Bullwinkel Partners, Ltd.

(57) ABSTRACT

An adjustable, stowable, ballet bar exercise device, comprising: a free-standing frame carrying at least one ballet bar, and one or more rigid members coupled to the frame and lying on the floor in use.

14 Claims, 6 Drawing Sheets

ADJUSTABLE BALLET BAR EXERCISE DEVICE

CROSS REFERENCE TO RELATED APPLICATION

This application claims priority of Provisional Application 60/233,507 filed on Sep. 19, 2000.

FIELD OF THE INVENTION

This invention relates to an adjustable-height ballet bar exercise device.

BACKGROUND OF THE INVENTION

Conventional ballet bars are permanently mounted to walls. They are thus limited to use around the perimeter of a room. This inefficient space utilization in commercial exercise rooms limits the size of classes, and so the income generated by the classes. For a home user, this limits the selection of rooms in which the device can be used, and also takes up valuable wall space.

Another drawback of conventional ballet bars is that they are mounted at a fixed height from the floor. However, the correct position of the bar is a function of the height of the user, a reality that is not addressed by conventional ballet bars.

SUMMARY OF THE INVENTION

It is therefore an object of this invention to provide a ballet bar that is portable.

It is a further object of this invention to provide a ballet bar of adjustable height.

It is a further object of this invention to provide a ballet bar exercise device that can carry either one or two bars.

It is a further object of this invention to provide such a device that allows the user to push down on the ballet bar as well as push up on the ballet bar in use.

It is a further object of this invention to provide such a device that can be used by either one or two people at the same time.

It is a further object of this invention to provide such a device that can be mounted to a wall.

It is a further object of this invention to provide such a device that accomplishes a greater density of users, thus increasing efficiency and income in commercial exercise classes.

It is a further object of this invention to provide such a device that is stable in use by either one or two people, but can be stowed in a small amount of space, for example in a closet or under a bed.

It is a further object of this invention to provide such a device that folds up into a relatively compact, flat package that can be easily carried and stowed away.

This invention features an adjustable, stowable, ballet bar exercise device, comprising: a free-standing frame carrying at least one ballet bar; and at least one mat member coupled to the frame. The frame may comprise at least two substantially vertical frame members. In the preferred embodiment, each of the vertical frame members comprises a collapsing construction (e.g., a telescoping device) of adjustable height. The collapsing construction may comprise a locking feature for releasably holding the ballet bar or bars at a plurality of heights.

The frame may further comprise at least two legs. At least one leg is preferably pivotably coupled to each substantially vertical frame member. There are preferably two legs pivoting on each vertical frame member. The frame may carry two ballet bars. The two bars may be coupled together in a ballet bar member. The ballet bar member is preferably pivotably coupled to the remainder of the frame.

Each mat member may comprise one mat, or two or more mats that lie on the floor in use, and are foldable one upon the other. The device may further comprise a substantially vertical backrest member coupled to the frame. The mat members preferably overlie the rigid planar members, and can each be folded up against the backrest into a stowed position.

In a more specific preferred embodiment, the invention features an adjustable, stowable, ballet bar exercise device, comprising: a free-standing frame carrying at least one ballet bar, wherein the frame comprises at least two substantially vertical frame members, each comprising a collapsing device of adjustable height, wherein each collapsing device comprises a locking feature for releasably holding at a plurality of heights, and wherein the frame further comprises at least two legs that are pivotably coupled to each vertical frame member; at least one ballet bar carried by the frame; a substantially vertical backrest member coupled to, or detachable from the frame; and at least one rigid member coupled to the backrest member or the frame, and which can be rotated to a horizontal position on the floor. Further included is at least one mat member, wherein each mat member comprises at least one mat that lies on the floor in use, and wherein each mat overlies a rigid member, so that it can be folded up against the backrest into a stowed position.

This invention also features a method of using an adjustable, stowable, ballet bar exercise device, comprising a free-standing frame carrying at least one ballet bar, and at least one rigid, planar member coupled to the frame and adapted to be placed on the floor proximate the frame, the method comprising a user placing at least a portion of the user's body on a rigid member, to apply a downward force on the rigid member and thus stabilize the frame, and the user placing another body portion on a ballet bar, to exercise by use of the device, wherein the user's body weight helps maintain the frame in position, to accomplish a free-standing ballet bar.

BRIEF DESCRIPTION OF THE DRAWINGS

Other objects, features and advantages will occur to those skilled in the art from the following description of the preferred embodiments and the accompanying drawings, in which.

DETAILED DESCRIPTION OF THE PREFERRED EMBODIMENTS

Figure 1:
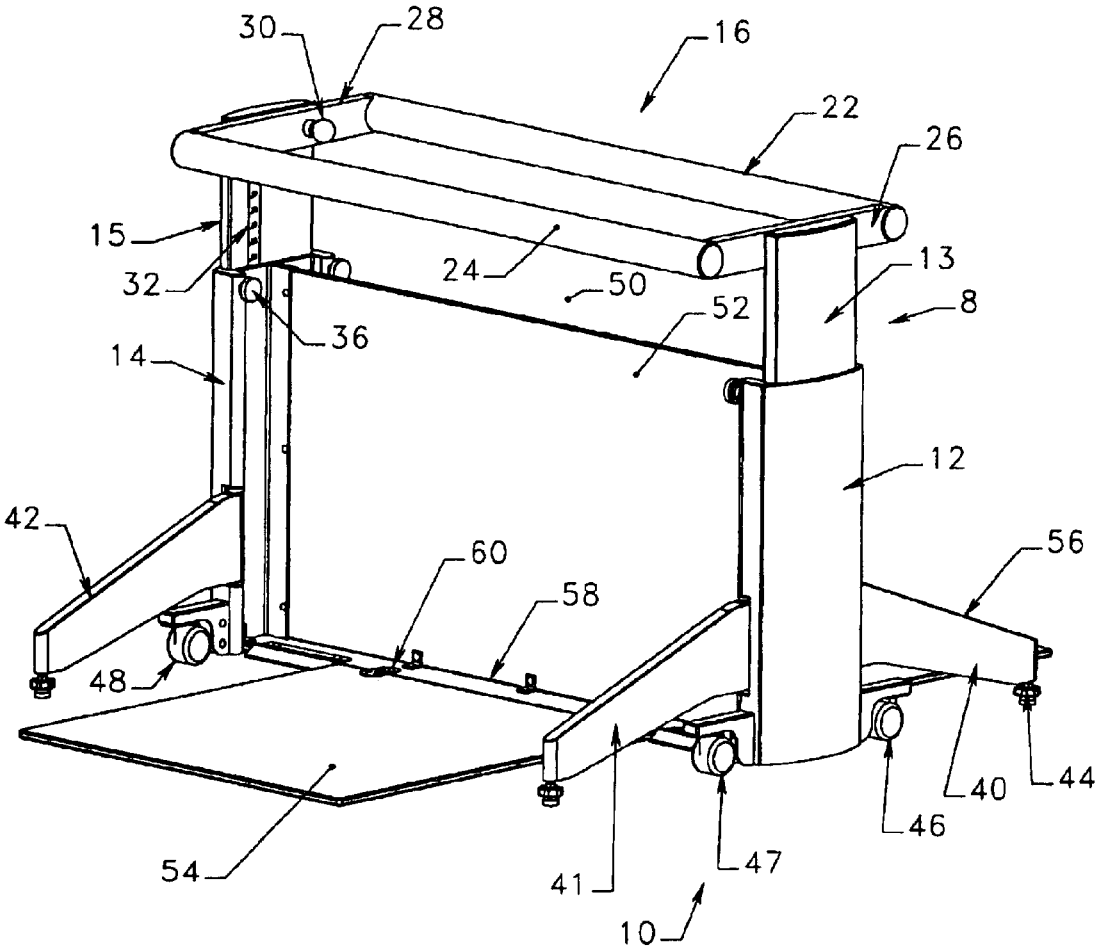
FIG. 1 is a detailed view of the preferred embodiment of the device of this invention deployed and ready for use.
Figure 2:
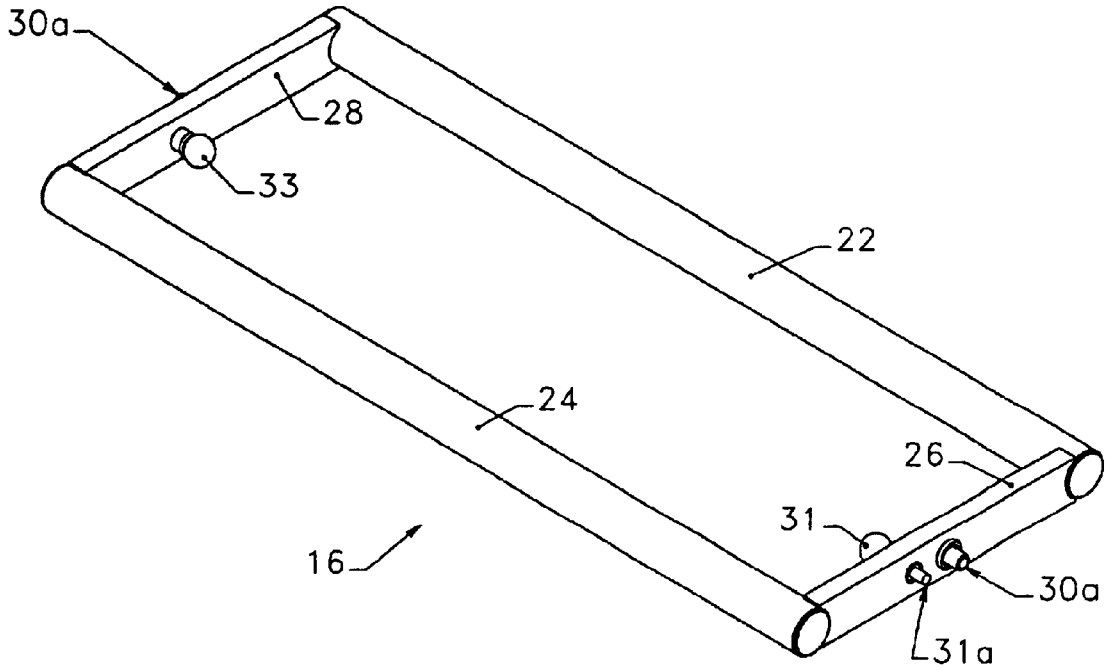
FIG. 2 is a more detailed view of the ballet-bar construction of the device of FIG. 1, showing how the construction pivots from the horizontal position shown to a vertical, stowed position and also showing how it is locked in place.

This invention may be accomplished in a portable, free-standing, adjustable-height foldable ballet bar exercise device. A preferred free-standing embodiment of this device is shown in FIGS. 1–5, with the device shown fully deployed in FIG. 1. Device 10 includes free-standing frame 8 comprising substantially vertical frame members 12 and 14 that are coupled to ballet bar construction 16. Construction 16 in this embodiment comprises two ballet bars, 22 and 24. However, this invention contemplates a device with only a single ballet bar as well. Construction 16 is designed to pivot about an axis defined by pivot pins 30*a*, as is more fully described below. Device 10 is made to be stable and free standing using pivoting leg members 40–43. Leg members 40 and 41 pivot on vertical frame member 12, and leg members 42 and 43 pivot on vertical frame member 14. The leg members preferably include adjustable-height feet 44, and a rubber, non-skid backing surface (not shown).

Ballet bar construction 16 is made so that the height of bars 22 and 24 are adjustable. This is preferably accomplished with adjustable-height members accomplished in any convenient mechanical means, such as collapsing with a sliding or telescoping action. In this embodiment, the collapsing action is accomplished with telescoping frame members 13 and 15. Connecting bar 26 and connecting bar 28 join ballet bars 22 and 24 to telescoping frame members 13 and 15. In this embodiment, the telescoping is accomplished by having telescoping members 13 and 15 that slide within vertical members 12 and 14, respectively, and may be releasably locked in a number of height positions by any convenient mechanical means as would be apparent to those skilled in mechanical arts. Shown are friction knobs 34 and 36 that hold telescoping frame member 15 at a height indicated by scale 32. This allows the ballet bar or bars to be collectively or individually set at a height that is comfortable for the user or users, while also allowing the device to be folded and stowed as described below. Individual height adjustment can be accomplished, for example, with two pairs of spaced telescoping members that slide within the vertical frame members, and each carry one bar.

Figure 3:
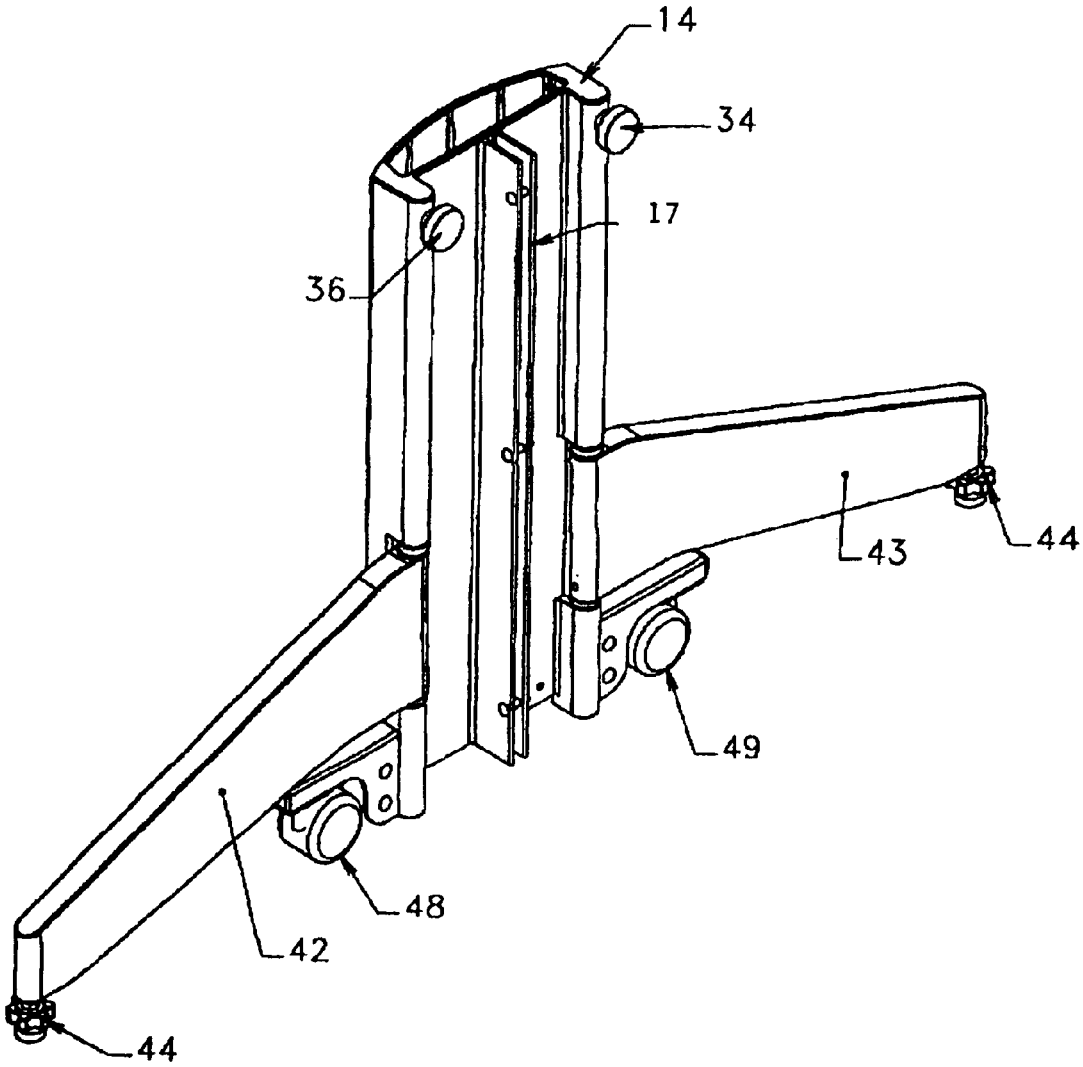
FIG. 3 is a more detailed view of one of the lower substantially vertical frame members and its two pivoting leg members and casters of the device of FIG. 1.

The lower construction of frame 8 is shown in more detail in FIG. 3. Vertical frame member 14 defines an opening that accepts telescoping frame member 15. Knobs 34 and 36 are attached to stems, not visible in the drawing, that are tightened against the adjustable-height frame member to hold it tightly in place at the desired height, so that the bars are set at a comfortable height for the users. Channel 17 holds one edge of vertical planar member (a.k.a. backrest member) 52, FIG. 4. Pivoting legs 42 and 43 are shown in the deployed position that stabilizes the device so that it doesn't tip when weight is applied to the bars. These legs pivot on pivot pins that are held within vertical frame member 14, not visible in the drawing, so that they can be folded up against the folded planar member and mat construction for storage, as further explained below. Caster wheels 48 and 49 allow the device to be wheeled in the stowed position so that it is easier to move into a storage closet or under a bed, for example. When deployed, adjustable-height feet 44 rest on the floor, and casters 49 and 48 are held off the floor.

Figure 4:
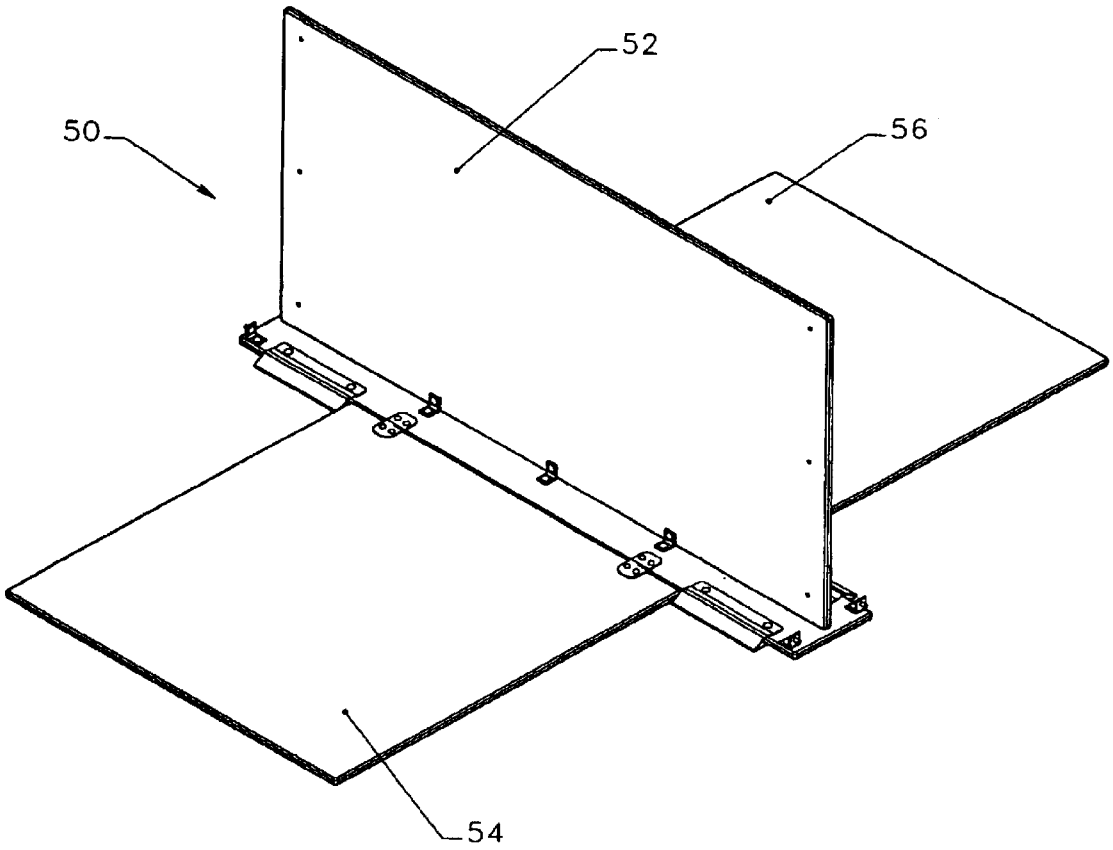
FIG. 4 shows an assembly of rigid planar members of the device of FIG. 1.

In addition to frame 8, device 10 comprises assembly 50, FIG. 4, of rigid planar members 52, 54 and 56 (e.g., plywood). Vertical rigid (backrest) member 52 is fixed to vertical frame members 12 and 14. Vertical rigid (backrest) member 52 rigidly locks vertical frame members 12 and 14 in vertical alignment. In the use position shown in FIG. 1, one user would stand, sit or lie on one or both of mats 76 and 78 (FIG. 5) while using ballet bar 22 or 24, while the other user would stand, sit or lie on one or both of mats 80 and 82 while using the other bar. Rigid planar members 54 and 56 located under mats 76 and 80, respectively, are affixed to backrest member 52. Since backrest member 52 is coupled to frame 8 of device 10, the user's weight and applied force maintains device 10 in position during use. Also, when the user's weight is on one or more of the rigid planar members 54, 56, the user can push up against one of the ballet bars 22, 24, and not dislodge the bar or device from position. Thus, the rigid planar members 54, 56 sitting on the floor and coupled to the frame 8 of the device allow the device to be used for exercises that apply force down, up or to the side of one or both ballet bars 22, 24. The mats sit on or are affixed to these rigid planar members 54, 56. The addition of an anti-skid surface to the bottom side of the rigid planar members 54, 56 keeps the unit from slipping laterally.

Figure 5:
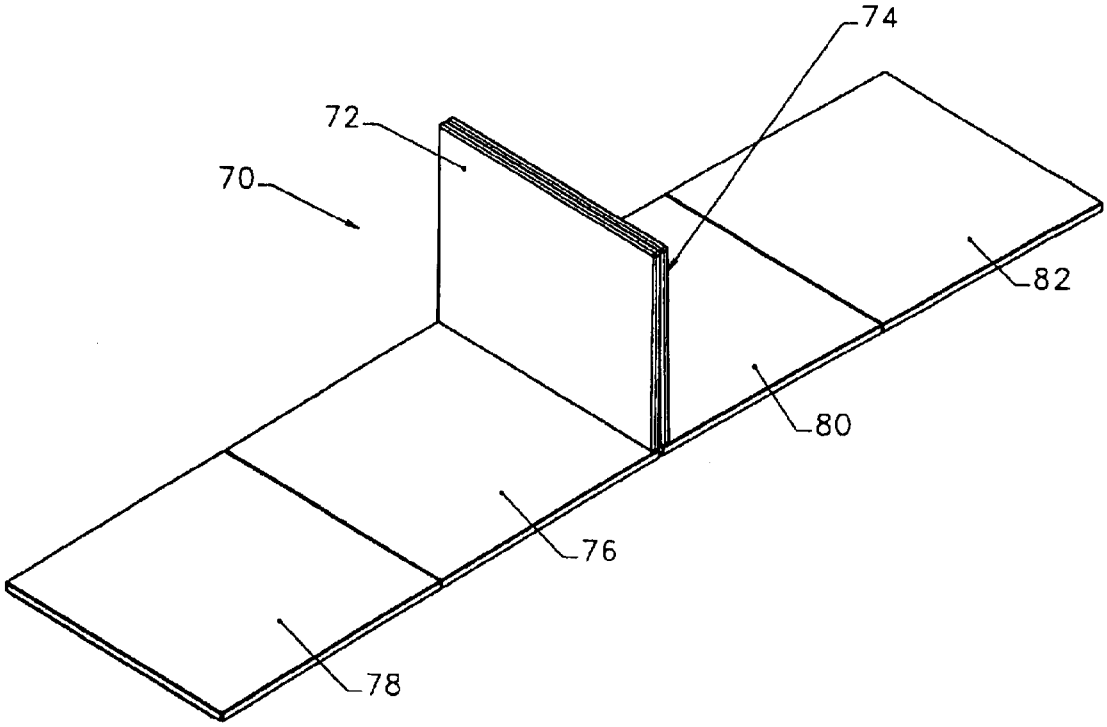
FIG. 5 details the mats that are placed over the assembly of FIG. 4.

Mat assembly 70, FIG. 5, includes central mats 72 and 74 that are placed over backrest member 52, FIG. 4. Mat 76 and 78 extend to one side, and mats 80 and 82 to the other side. Preferably, these mats are hingedly connected together with living hinges or fabric hinges, for example, so that they can be folded together for storage, as explained below.

The device of FIGS. 1–4 can be folded into a relatively flat structure for storage, as follows: Ballet bar construction 16 is designed to pivot on a horizontal axis passing through pivot points 30*a*, FIG. 2, so that it can be rotated to a vertical position in which bars 22 and 24 are one above the other. Ballet bar construction 16 can then be pushed down, causing telescoping frame members 13 and 15 to move down within vertical frame members 12 and 14, respectively, to decrease the overall height of the device. The mats are arranged to allow a folding or pivoting action between them as follows. Mat 78 can be folded up and onto mat 76. Similarly, mat 82 can be folded onto mat 80. Rigid planar members 54 and 56 fold up to a vertical position containing the mats. The device in this stowed position thus presents a relatively flat package having a width about the width of vertical frame members 12 and 14, and a height substantially less than shown in FIG. 1. The device can carry wheels, preferably on the bottom of each of vertical frame members 12 and 14, and preferably retractable and deployable so that, when the device is in use, the wheels do not touch the floor, and when the device is in the stowed position, the wheels can be moved out from their retracted position so that the device can be rolled. Alternatively, the stowed device can be carried by one of bars 22 or 24.

The invention can be accomplished with alternative frame designs, as long as the device is portable, and carries one or more ballet bars of adjustable height. For example, the side frame members need not be vertical, or more than two supporting members could be used. Also, the bar or bars do not need to pivot relative to the frame. Also, the ballet bars do not have to rotate in order to be vertically adjustable.

Figure 6:
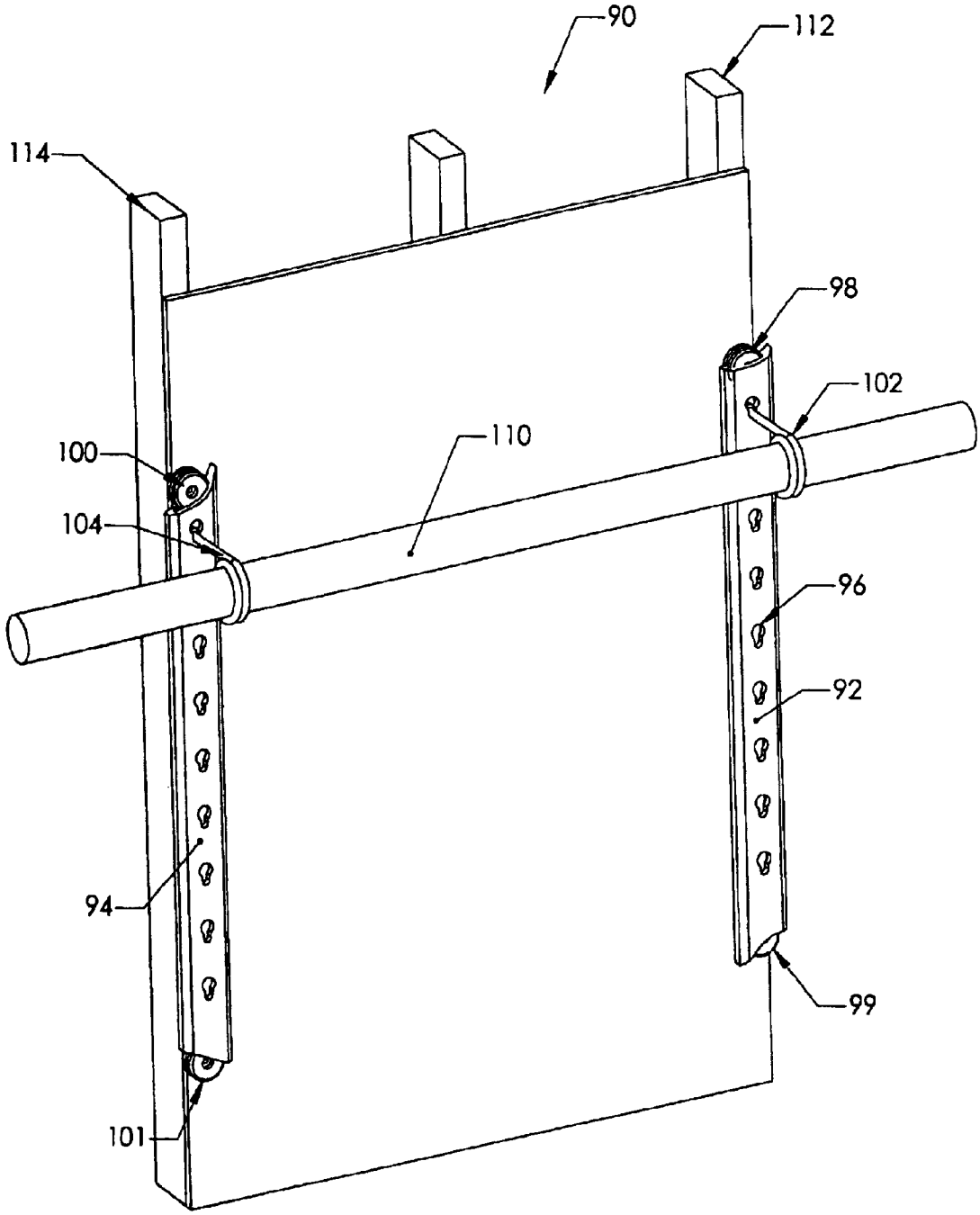
FIG. 6 is a front view of an alternative embodiment of the invention detailing an adjustable height wall-mounted ballet bar of the invention.

Another embodiment of the invention comprising a wall-mounted ballet bar which is adjustable in height and removable for storage, is shown in FIG. 6. Two vertically spaced holes are drilled in each of wall studs 112 and 114, and an anchor assembly is inserted into each hole. Removable vertical bars 92 and 94 are placed over anchor assemblies 98 and 99, and 100 and 101, respectively. These vertical bars have a number of spaced holes so that ballet bar 110 can be held at a desired height. Mounting brackets 104 and 102 engage with bars 94 and 92, respectively, and hold ballet bar 110. Thus, the ballet bar and the vertical bars are easily removed from the wall when not in use.

Other embodiments will occur to those skilled in the art and are within the following claims:

What is claimed is:

1. An adjustable, stowable, ballet bar exercise device, comprising:

a free standing frame carrying at least one ballet bar;

at least one member coupled to the frame and adapted to be placed on the floor proximate the frame; and a substantial vertical backrest member couple to the frame, wherein the at least one member coupled to the frame is a rigid planar member coupled to the backrest member and wherein the rigid planar members are pivotally coupled to the frame or the backrest members, so that they can each be folded up against the frame into a stowed position.

2. The device of claim 1, wherein the frame comprises at least two substantially vertical frame members.

3. The device of claim 2, wherein the frame further comprises at least two legs.

4. The device of claim 3, wherein at least one leg is pivotably coupled to each substantially vertical frame member.

5. The device of claim 4, wherein there are two legs pivoting on each vertical frame member.

6. The device of claim 2, wherein each substantially vertical frame member comprises a collapsible construction of adjustable height.

7. The device of claim 1, wherein the frame carries two ballet bars.

8. The device of claim 7, wherein the two bars are coupled together in a ballet bar construction.

9. The device of claim 7 wherein the two bars are independently vertically adjustable.

10. The device of claim 8, wherein the ballet bar construction is pivotably coupled to the frame.

11. The device of claim 6, wherein the collapsing construction comprises a locking feature for releasably holding the at least one ballet bar at a plurality of heights.

12. The device of claim 1 wherein the vertical backrest member assists in holding the frame in a vertical position.

13. An adjustable, stowable, ballet bar exercise device, comprising:

a free-standing frame carrying at least one ballet bar, wherein the frame comprises at least two substantially vertical frame members, each comprising a collapsing device of adjustable height, wherein each collapsing device comprises a locking feature for releasably holding at a plurality of heights, and wherein the frame further comprises at least two legs that are pivotably coupled to each vertical frame member;

at least one ballet bar carried by the frame;

a substantially vertical backrest member coupled to the frame;

at least one rigid member hingedly coupled to the backrest member or the frame, and which can be rotated to a horizontal position on the floor; and at least one mat member, wherein each mat member comprises at least one mat that is adapted to lie on the floor in use, and wherein each mat overlies a rigid member, so that it can be folded up against the backrest into a stowed position.

14. A method of using an adjustable, stowable, ballet bar exercise device, comprising a free-standing frame carrying at least one ballet bar, and at least one rigid, planar member coupled to the frame and adapted to be placed on the floor proximate the frame and a substantially vertical backrest member coupled to the frame wherein the at least one member coupled to the frame is a rigid planar member coupled to the backrest member, wherein the rigid planar members are pivotally coupled to the frame or the backrest member, so that they can each be folded up against the frame into a stowed position, the method comprising:

a user placing at least a portion of the user's body on a rigid member, to apply a downward force on the rigid member and thus stabilize the frame; and the user placing another body portion on a ballet bar, to exercise by use of the device, wherein the user's body weight helps maintain the frame in position, to accomplish a free-standing ballet bar.

* * * * *